US007040889B2

(12) United States Patent
Tsai

(10) Patent No.: US 7,040,889 B2
(45) Date of Patent: May 9, 2006

(54) BURNER

(76) Inventor: Chin-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 71 days.

(21) Appl. No.: 10/745,600

(22) Filed: Dec. 29, 2003

(65) Prior Publication Data

US 2004/0180306 A1 Sep. 16, 2004

(30) Foreign Application Priority Data

Mar. 12, 2003 (TW) ..... 92221296 U

(51) Int. Cl.
*F23Q 7/12* (2006.01)

(52) U.S. Cl. ..... 431/255; 431/344

(58) Field of Classification Search ..... 431/255 O, 431/344 X, 153; 126/405, 406 X, 407
See application file for complete search history.

(56) References Cited

U.S. PATENT DOCUMENTS 4,643,671 A * 2/1987 Yoshinaga ..... 431/255
5,573,393 A * 11/1996 Tsai ..... 431/255
5,647,738 A * 7/1997 Tsai ..... 431/255
5,741,128 A * 4/1998 Tsai ..... 431/255
6,293,782 B1 * 9/2001 Tsai ..... 431/153
6,527,543 B1 * 3/2003 Tsai ..... 431/153

* cited by examiner

*Primary Examiner*—Alfred Basichas
(74) *Attorney, Agent, or Firm*—Troxell Law Office, PLLC

(57) ABSTRACT

A burner with a stable mechanism stretching out from a proper location on the circumference, a stable slot is between two shaft slices with a connecting part, the piezo-electric device is a modulized body a piezo-electric module is inside the modulized body, one end of the piezo-electric module stretches out from the shell and is against the shaft, the other end connects to a press button, a conducting rod connects out from the piezo-electric module, and is apart from the burner cap, a combining object is on the location corresponding to the shaft slices; the modulized body can be combined with or detached from the stable slot by the combination or detachment of the combining object and the shaft slices. Users can press the press button and trigger the sparks between the conducting rod of the piezo-electric module and the burner cap to ignite fuel.

20 Claims, 8 Drawing Sheets

BURNER

BACKGROUND OF THE INVENTION

1. Field of the Invention

This invention relates generally to a burner and, more specifically, to a burner with detachable piezo-electric device that can be combined with or detached from the main body rapidly for safer and easier to maintain purpose.

2. Description of the Prior Art

Heretofore, it is known that people have applied fuel to cooking and lighting for a long time, now all kinds of fuel and energy sources are available, liquid gas is a very common fuel.

Compressed liquid gas is not only used in household, it is also used in cigarette lighters because it is clean and easy to refill. Therefore, it is widely used in stoves and put to other industrial applications nowadays. However, most of the gas burners or heaters avoid external igniter, therefore they have a piezo-electric device, users can press the piezo-electric device to generate electrostatic sparks and pass through a conducting wire to ignite the combined fuel gas escaped from the gas diffusion burner head or the firing mechanism. U.S. Pat. No. 5,573,393 of applicant is an obvious example.

The piezo-electric device mentioned above might be damaged after a long period of time for been pressed, the piezo-electric device is built inside and is not easy to be replaced by users, users have to rely on manufactures or sales rep. to repair, that causes inconvenience.

Therefore, if the piezo-electric device and the burner can be combined and detached freely and flexibly, then users can overcome the inconvenience of replacement and repairing. While the piezo-electric device is not in use, users can take it out to avoid the misuse by children.

SUMMARY OF THE INVENTION

It is therefore a primary object of the invention to provide a burner with a stable mechanism stretching out from a proper location on the circumference, a stable slot is between two shaft slices with a connecting part, the piezo-electric device is a modulized body comprising two shell body connecting together, a piezo-electric module is inside the modulized body, one end of the piezo-electric module stretches out from the shell and is against the shaft, the other end connects to a press button, a conducting rod connects out from the piezo-electric module, the conducting rod is apart from the burner cap, a combining object is on the location corresponding to the shaft slices; the modulized body can be combined with or detached from the stable slot by the combination or detachment of the combining object and the shaft slices. Users can press the press button and trigger the sparks between the conducting rod of the piezo-electric module and the burner cap to ignite fuel.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
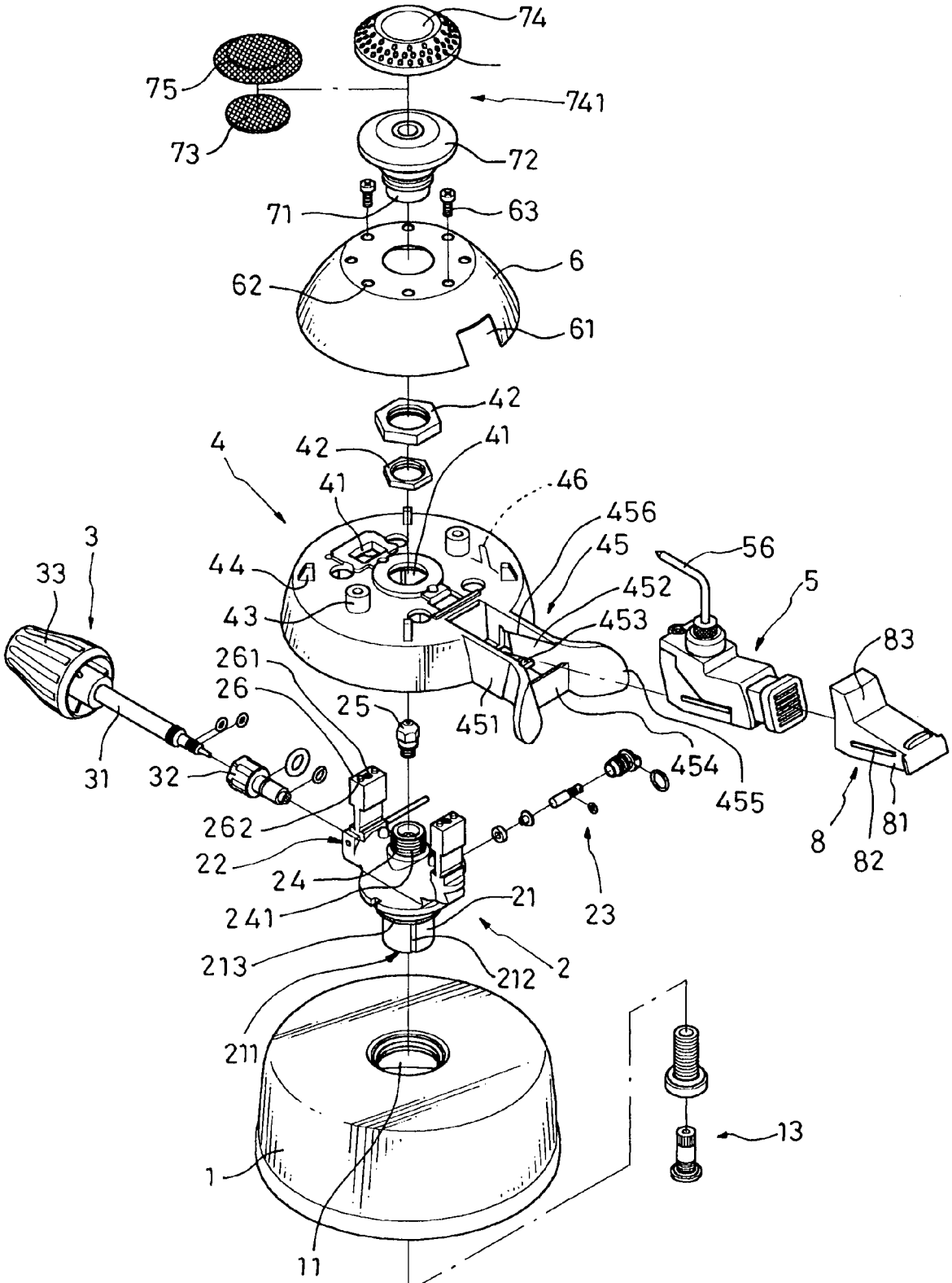
FIG. 1 is an exploded view of the present invention.
Figure 2:
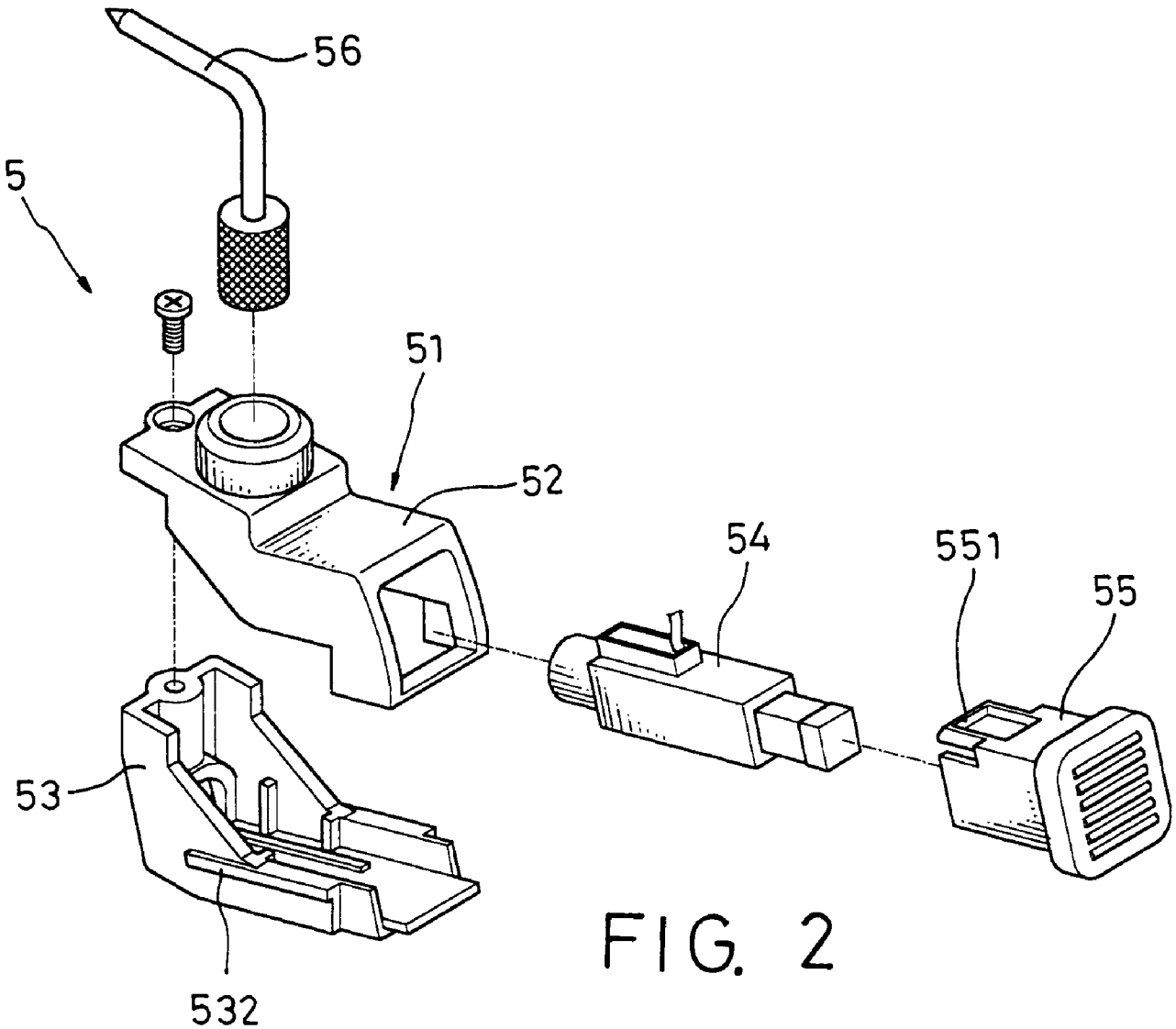
FIG. 2 is an exploded view a further embodiment of the present invention.
Figure 3:
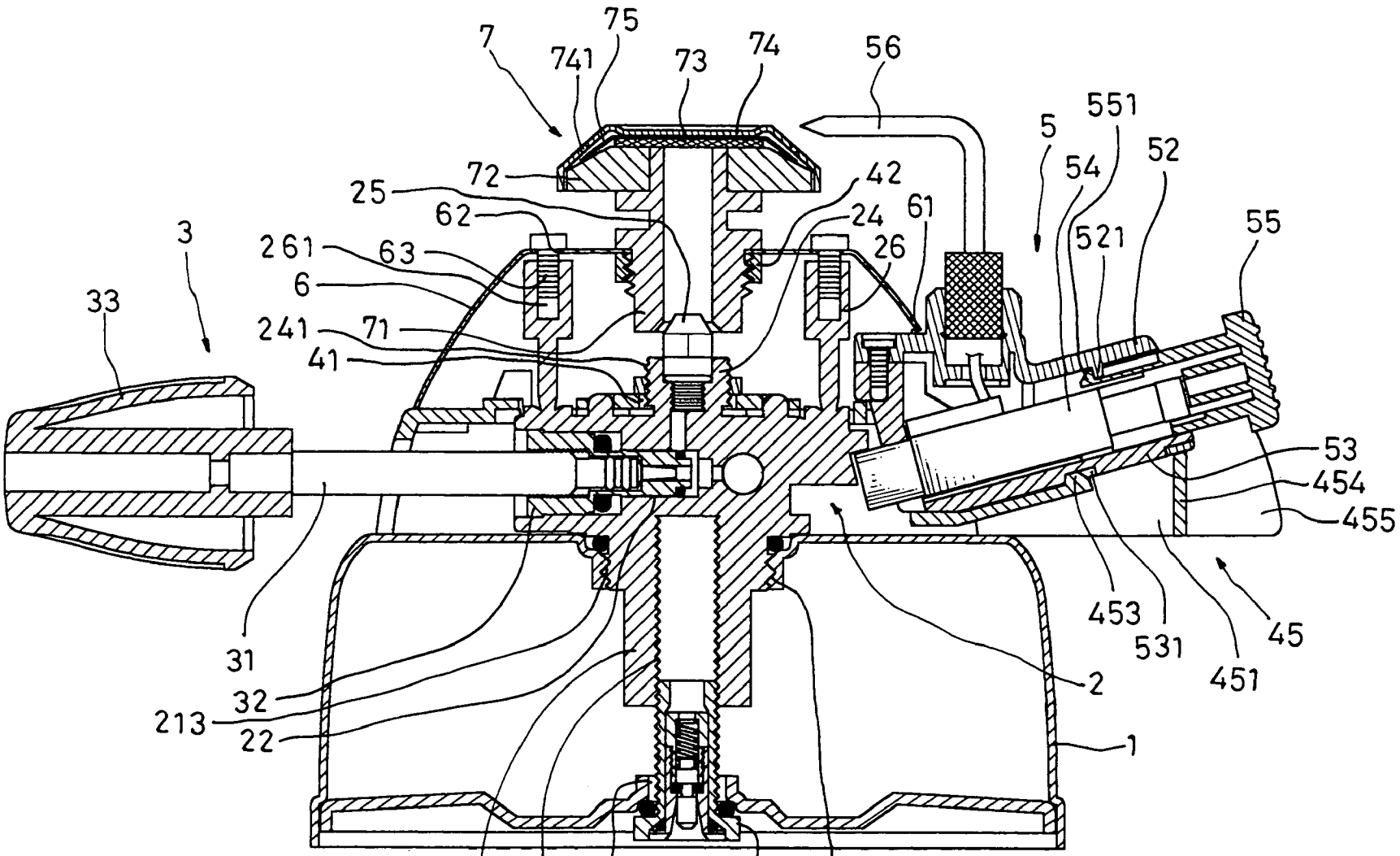
FIG. 3 is across-sectional view of the present invention.

Referring to FIGS. 1 to 4, the present invention is composed of storage tank 1, a supporting rack 2, a control device 3, a platform 4, a piezo-electric device 5, a hood 6 and a burner cap 7. The functions of each component are described below:

The storage tank 1 is a container for fuel; a tank hole 11 on top connects firmly (screw together, for example) to the supporting rack 2, the pillar 21 of the supporting rack 2 is above the connecting hole 12 of the storage tank 1, a filling connector 13 passes through the connecting hole 12 and is screwed with the pillar hole 211 of the pillar 21, the fuel, liquid gas for example, can go from the pillar duct 212 under the pillar hole 211 and enter the storage tank 1.

The supporting rack 2 is in rack shape, the bottom of the pillar 21 connects to the tank hole 11 with the pillar thread 213, the fuel enters a fluid tunnel 22 and passes a fluid regulator 23 listed in U.S. Pat. No. 5,573,393 of applicant to have the amount of fuel controlled and on/off by the control device 3. A hollow pillar 24 is on the top of the supporting rack 2 and connects to the fluid tunnel 22, a inject tube 25 is on top of the hollow pillar 24 to inject the vaporized fuel. A shaft 26 each protrudes from both sides of the supporting rack 2 and connects to the hood 6. For heat insulation purpose, at least one protruding point 262 is on top of the shaft 26 and adjacent to the screw hole 261 to touch the inner wall of the hood 6.

The control device 3 is the same as the U.S. listed U.S. Pat. No. 5,573,393 of applicant; the control device 3 comprises a control rod 31, a shutoff valve 32 and a knob 33, the shutoff valve 32 is fixed on one outlet of the fluid tunnel 22 and is screwed with the control rod 31. When users turn the knob 33, the control rod 31 opens, closes or controls the inlet of the shutoff valve 32 to turn on/of and control the amount of fuel.

Figure 4:
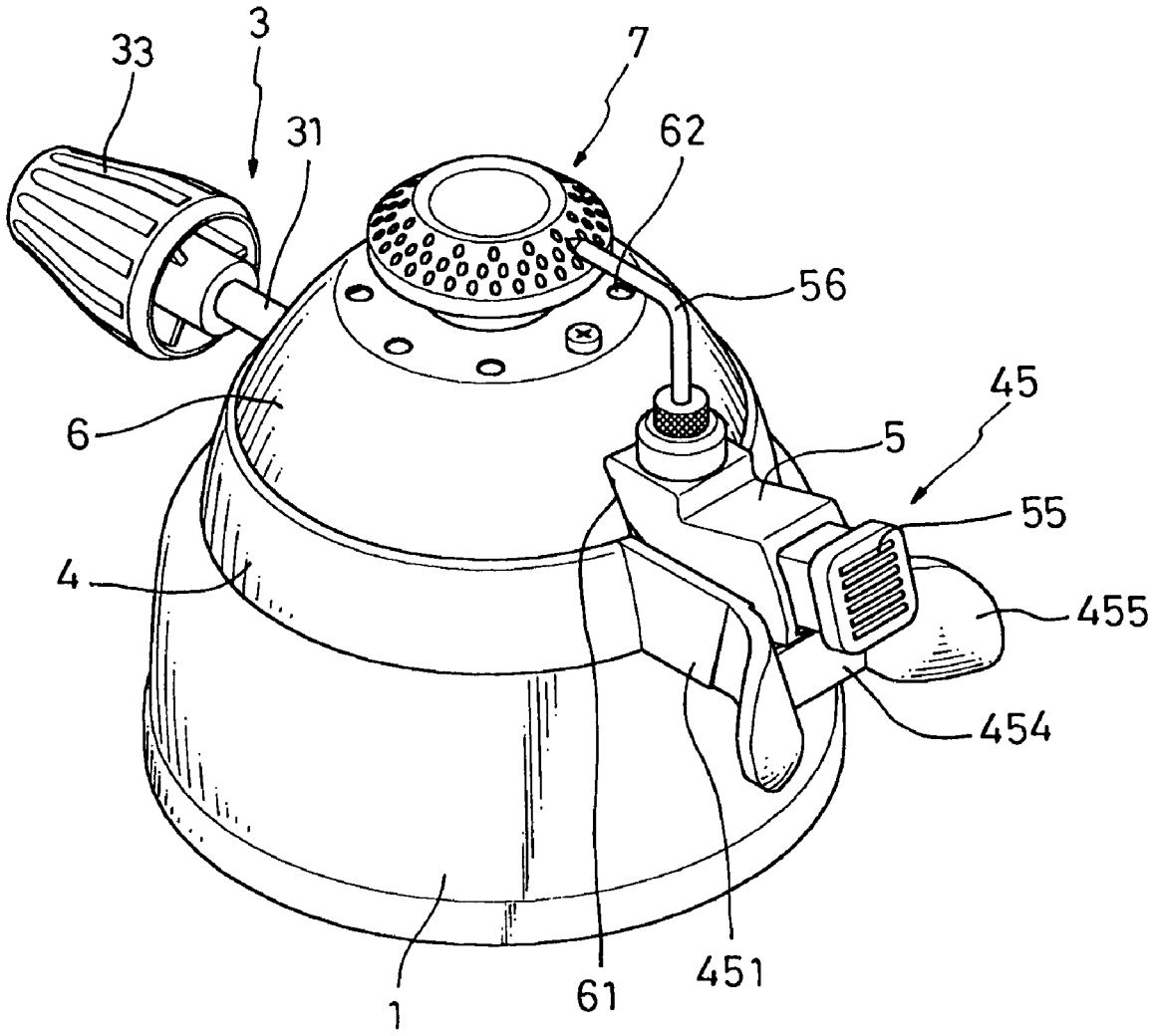
FIG. 4 is a perspective view of the present invention.

The platform 4 is in cover shape, two cover hole 41 each corresponds to the location of the shaft 26 and the inject tube 25 for them to stretch out; a fixing mechanism 42 is fixed with the pillar thread 241 of the hollow pillar 24 to stable the platform 4 firmly on top of the storage tank 1. At least two hood pillar 43 are on the top of the platform 4 to connect the hood 6, as shown in FIG. 4 or FIG. 5; several oblique tenon 44 are around the top circumference of the platform 4 to hold the hood 6.

A stable mechanism 45 with two shelf slice 451 forming a stable slot 452 stretches out from the brim of the platform 4 for the piezo-electric device 5 to place stably, the bottom of the two shelf slice 451 have a connecting part 453 stretching out, a spring with buckle for example; in order to strengthen the connecting effect of the shelf slice 451, a strengthen slice 454 is connected between the external side of the shelf slice 451; the ends of the shelf slice 451 bend openly and form a pressing slice 455, users can press it with fingers. A concave slot 46 each corresponding to the control rod 31 and the fluid regulator 23 are on the circumference of the platform 4 for control rod 31 to stretch out or for a hand tool to insert into the platform 4 to adjust the fluid regulator 23.

The piezo-electric device 5 is a modulized body 51 comprising an upper shell 52 and a lower shell 53 connecting together. A piezo-electric module 54 is inside the modulized body 51, one end of the piezo-electric module 54 stretches out from the lower shell 53 and is against the shaft 26; the other open of the upper shell 52 wraps around a press button 55, a button hook 551 is on the front of the press button 55 to hook on the convex stopper 521 inside the upper shell 52, when the press button 55 bounces back, the convex stopper 521 stops the press button 55 from coming out. A combining object 531, fastener slot for example, is on the bottom of the lower shell 53, when the modulized body 51 is inserted into the stable slot 452, the combining object 531 buckles, with the connecting part 453 firmly. A convex shell rib 532 each is on the front and back of the lower shell 53 to be against the crosspiece 456 inside the shelf slice 451 so the modulized body 51 will not come up from the platform 4. When users press the press button 55, the other end of the press button 55 is against, pressed by the shaft 26 and generated static electricity, the static electricity is transmitted by the "L" shape conducting rod 56 on the upper shell 52 and generates sparks on the burner cap 7 to ignite fuel.

The piezo-electric device 5 can be detached and combined with the platform 4 rapidly and conveniently, the piezo-electric module 54 can be repaired and installed conveniently. While not use, users can pull the piezo-electric module 54 out and function as a "key". In order not to have alien objects from entering the platform 4 while the piezo-electric module 54 is out, a stuff body 8 with stuff shell 81 and stuff rib 82 can be installed onto the stable slot 452, and seals the open with a convex wall 83.

The hood 6 is in awl cap shape, the hood 6 is placed on top of the platform 4 after it is combined with the burner cap 7; the inner wall of the hood 6 sticks with the oblique tenon 44; a hood open 61 is corresponding to the location of the piezo-electric device 5; several ventilation hole 62 are on top of the hood 6 for air to come in, the air along with the vaporized fuel injected by the inject tube 25 enters into the burner cap 7. Several screw 63 pass through and are fixed onto the screw hole 261.

Referring to FIGS. 5*a* to 6*b*, showing another application of the hood 6*a*, the height of 6*a* is shorter than that of the hood 6 described; the hood 6*a* is fixed by screw 63*a* passing through the hood hole 62*a* onto the hood pillar 43, air enters from the hood hole 62*a* that connects to the hood open 61*a*. The shaft 26 is not used while applying hood 6*a* for lower height.

Referring to FIGS. 1 to 4, the burner cap 7 connects to the hood 6 with a hollow pillar 71 fastened with screws or buttons; a bottom plate 72 connects to top of the burner cap 7 fastened with nails or buttons; a filter net 73 is on top of the hollow pillar 71 to avoid alien objects from coming in, an air scattering plate 74 and an air scattering net 75 follow and are fixed on the top of the bottom plate 72; the vaporized fuel and air pass through the filter net 73 are distributed by the scattering plate, and injected from the plate hole 741 of the scattering plate 74. At the same time, the conducting rod 56 generates electric sparks to ignite fuel.

Figure 5A:
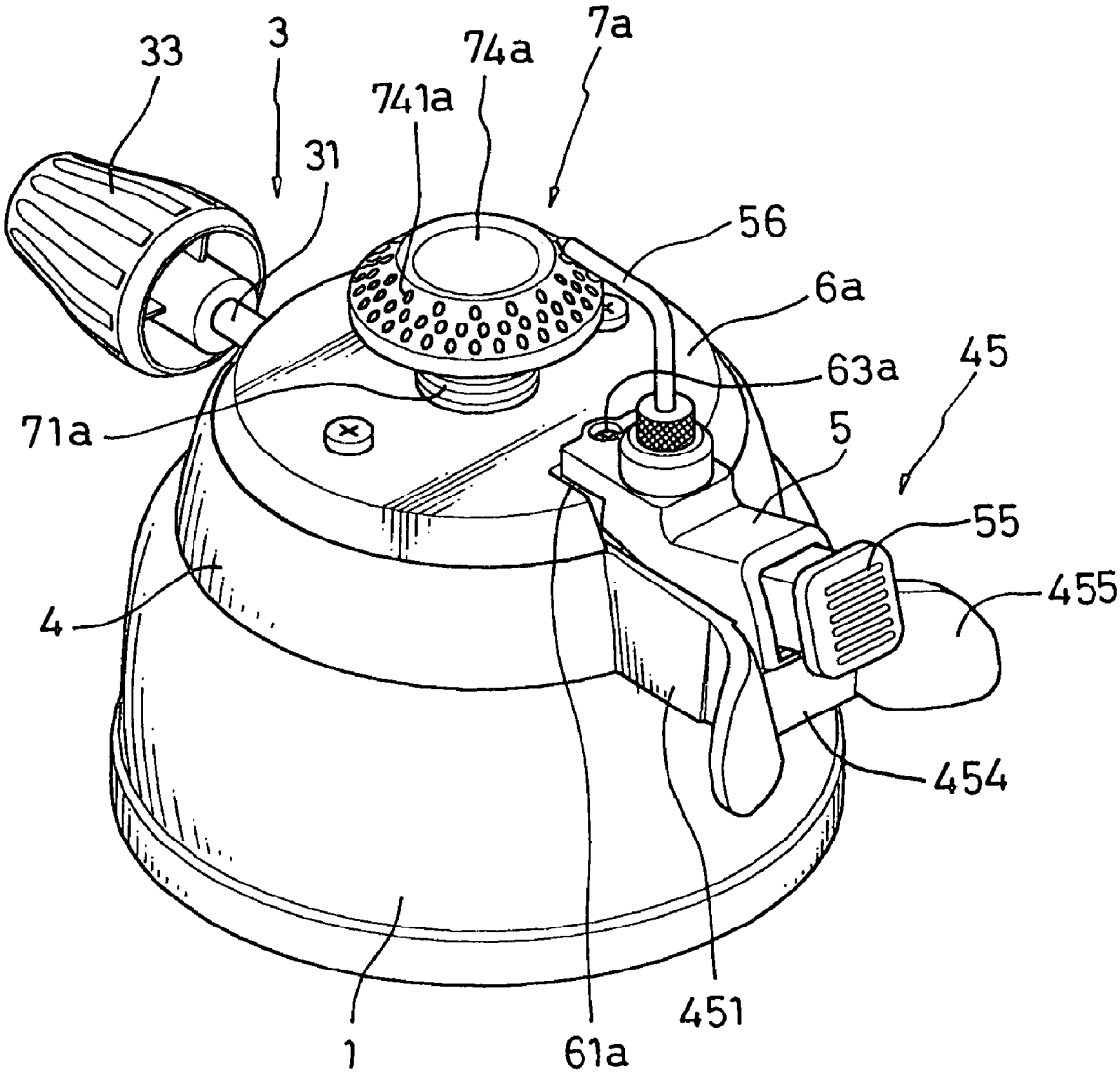
FIGS. 5*a* and 5*b* are the second application views of a further embodiment of the present invention.
Figure 5B:
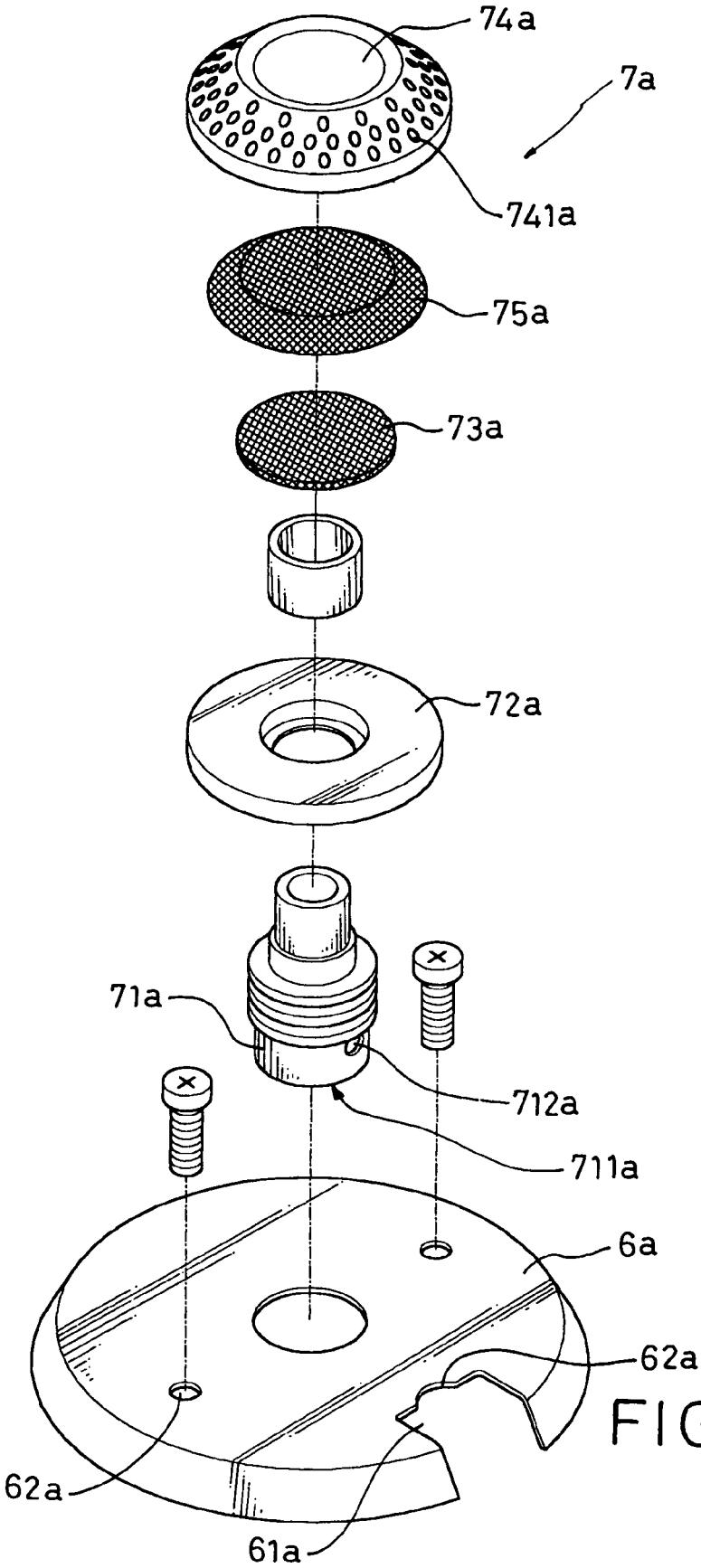

Referring to FIGS. 5*a* and 5*b*, showing another application of the burner cap 7*a*, the burner cap 7*a* connects to the hood 6*a* according to the method described above; a hollow pillar 71*a* connects to a bottom plate 72*a* on top, an air scattering plate 74*a* and an air scattering net 75*a* follow and are fixed on the top of the bottom plate 72*a*, the air scattering plate 74*a* and plate hole 741*a* are same as description above, the only difference is an inner thread 711*a* is on the bottom of the hollow pillar 71*a* to screw with the pillar thread 241, so the hollow pillar 71*a* can connect to the pillar 24 directly and cover inject tube 25, an air inlet hole 712*a* is on the hollow pillar 71*a* for air to enter into the hollow pillar 71*a*.

Figure 6A:
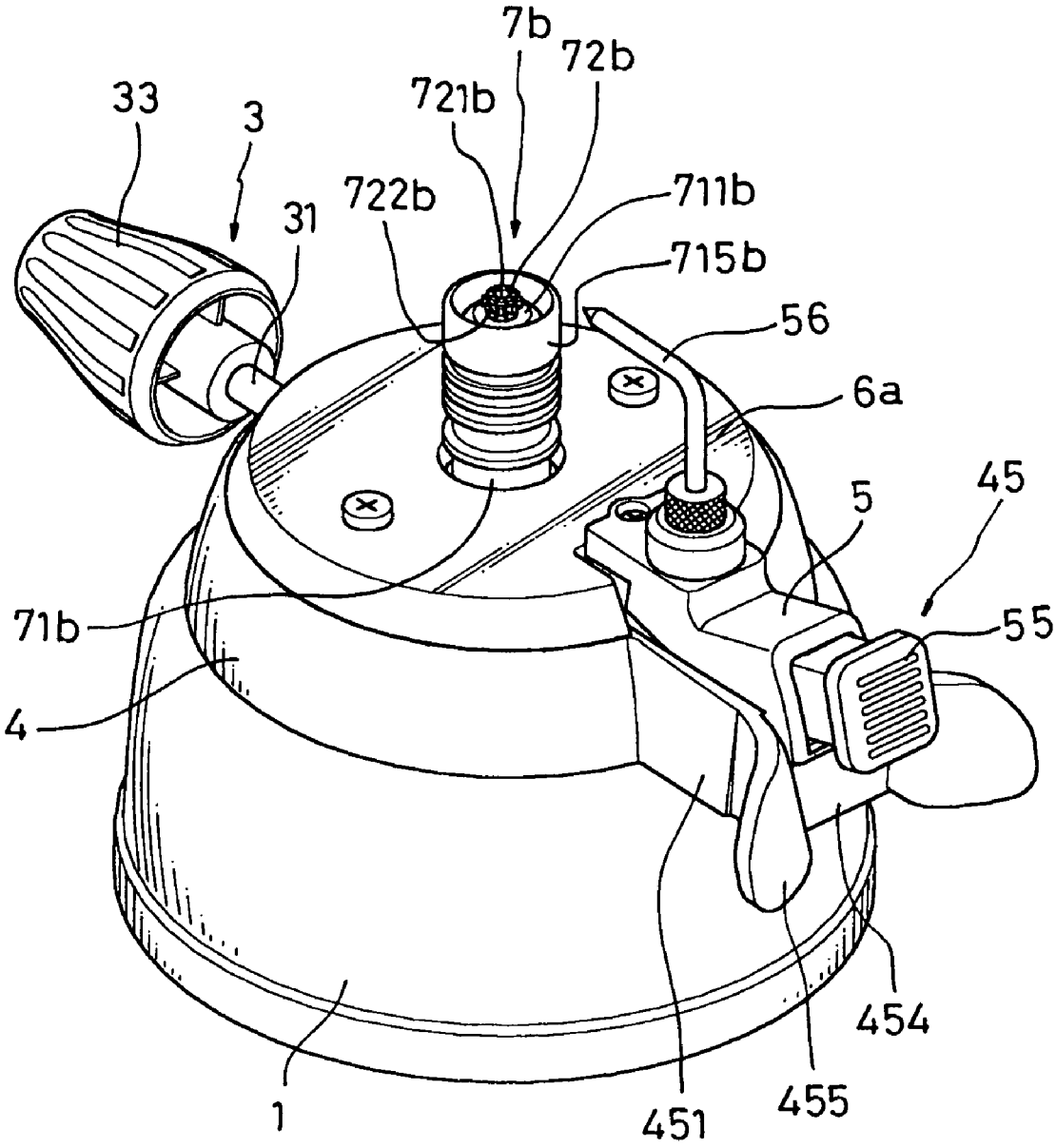
FIGS. 6*a* and 6*b* are the third application views of a further embodiment of the present invention.
Figure 6B:
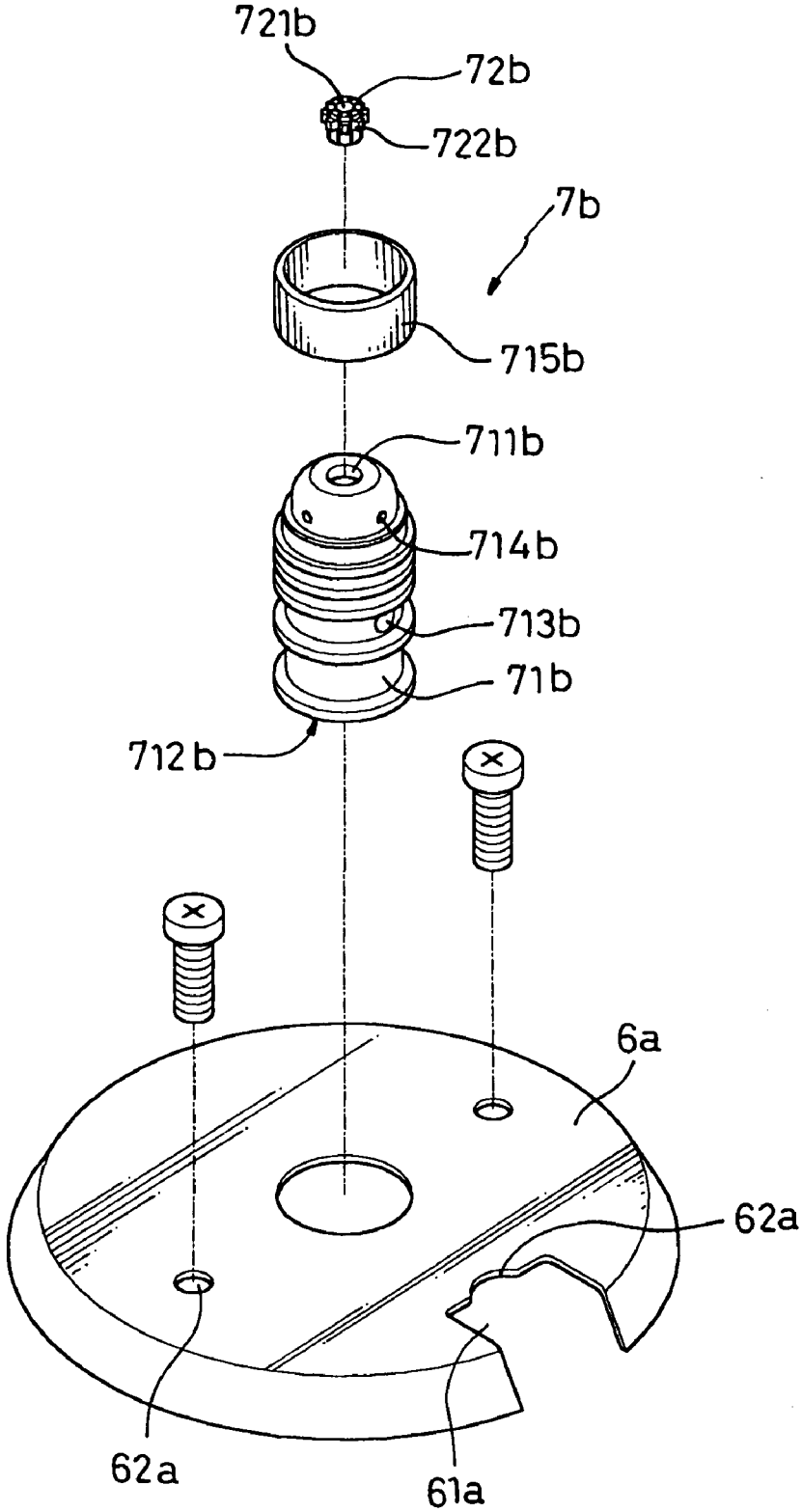

Referring to FIGS. 6*a* and 6*b*, showing the third application of the burner cap 7*b* and the hood 6*a*, a flame outlet 721*b* and several airflow distributor 72B with round teeth 722*b* are on the center of airflow guide 711*b* that is on the top of the hollow pillar 71*b*, such mechanism can have the flame outlet 721*b* inject flame and small pilot fires are on the intervals of the teeth, while the fuel is in small quantity, the flame will not go out. An inner thread 712*b* is on the bottom of the hollow pillar 71*b* to screw with the pillar thread 241, so the hollow pillar 71*b* can connect to the pillar 24 directly and cover inject tube 25, an air inlet hole 713*b* is on the hollow pillar 71*b* for air to enter into the hollow pillar 71*b*. Several side hole 714*b* are installed horizontally on the hollow pillar 71*b* and are surrounded by a block ring 715*b*, when the fuel is in large quantity, such arrangement can also form pilot fire effect.

Based on above description, the third application can be detached and joined the burner freely, users can do repair or replacement easily. The protruding points on top of the shaft can reduce the contact between the hood and the platform for better heat insulation effect. The piezo-electric device can be taken out and have a stuff body to seal the stable slot, such mechanism can avoid children from misuse without flame starter to avoid unpredicted danger.

While a preferred embodiment of the invention has been shown and described in detail, it will be readily understood and appreciated that numerous omissions, changes and additions may be made without departing from the spirit and scope of the invention.

What is claimed is:

1. A burner comprising:

a) a storage tank for storing a fuel;

b) a supporting rack connected to a top of the storage tank;

c) a control device located in the supporting rack and controlling a flow of fluid through the supporting rack;

d) a platform located on a top of the supporting rack and having a stable mechanism having:

i) two shelf slices being spaced apart and defining a stable slot; and ii) a strengthening slice located between and connected to the two shelf slices;

e) a hood located above the platform and connected to the supporting rack;

f) a burner cap connected to a top of the hood; and g) a piezo-electric device selectively inserted into and removed from the stable slot of the stable mechanism of the platform and having:

i) a modular body having two shells;

ii) a piezo-electric module located between the two shells of the modular body and having a first end engaging a main body of the supporting rack and a second end engaging a press button; and iii) a conducting rod being connected to the piezo-electric module at a first end thereof and having a second end extending outwardly from a top of the modular body, the second end of the piezo-electric module being spaced a predetermined distance from the burner cap, wherein, when the press button is pushed inwardly, the piezo-electric device generating sparks between the piezo-electric module and the burner cap.

2. The burner according to claim 1, wherein the storage tank has a tank hole located on a top thereof, a connecting hole located in a bottom thereof, and a filling connector inserted through the connecting hole, the supporting rack has a pillar located on a bottom thereof and inserted into the storage tank through the tank hole, the pillar is located above the connecting hole, the filling connector is connected to a pillar hole of the pillar, the fuel is inserted into the storage tank through the filling connector.

3. The burner according to claim 1, further comprising an inject tube located between the supporting rack and the burner cap, the fuel flows from the storage tank to the inject tube through a fluid tunnel of the supporting rack, the fluid is injected into the burner cap by the inject tube.

4. The burner according to claim 3, further comprising a flow regulator located in the fluid tunnel and controlled by the control device.

5. The burner according to claim 4, wherein the control device includes a control rod, a shutoff valve located on a first end of the control rod, and a knob located on a second end of the control rod, the shutoff valve is fixed in an outlet of the fluid tunnel, the knob selectively moving the an inlet of the shutoff valve between open and closed positions.

6. The burner according to claim 1, wherein the support rack includes two shafts protruding upwardly from opposing sides thereof, the platform has two cover holes located on opposing sides thereof, one of the two shaft being inserted through each of the two cover holes.

7. The burner according to claim 6, wherein a top of each of the two shafts is connected to the hood.

8. The burner according to claim 6, wherein each of the two shafts has at least one protruding point engaging a bottom of the hood.

9. The burner according to claim 1, wherein the platform has at least two hood pillars protruding upwardly from a top thereof, the hood being connected to each of the at least two hood pillars.

10. The burner according to claim 1, wherein the two shelf slices of the stable mechanism are parallel.

11. The burner according to claim 1, wherein the stable mechanism has a connecting part located between the two shelf slices, the modular body has a combining slot located on a bottom thereof, the connecting part selectively engaging the combining slot and securing the piezo-electric device in the stable mechanism.

12. The burner according to claim 1, wherein the modular body has a convex shell rib located on each of two opposing sides thereof, each of the two shelf slices of the stable mechanism has a cross piece located on a side surface thereof within the stable slot, each convex shell rib being held in the stable slot by one cross piece.

13. The burner according to claim 1, further comprising a stuff body having:

a) a stuff shell;

b) a stuff rib located on opposing sides of the stuff body; and c) a convex wall located on a top portion of the stuff body, wherein, when the piezo-electric device is removed from the stable slot of the stable mechanism the stuff body is selectively inserted into the stable slot and the convex wall sealing an opening in the stable slot.

14. The burner according to claim 1, wherein the hood has a plurality of ventilation holes located thereon.

15. The burner according to claim 1, wherein the hood has a hood opening, the stable mechanism protruding outwardly through the hood opening.

16. The burner according to claim 1, wherein the burner cap having:

a) a burner hollow pillar connected to the hood;

b) a bottom plate located on a top of the burner hollow pillar;

c) a filter net located on a top of the bottom plate; and d) an air scattering net and an air scattering plate located above the bottom plate.

17. The burner according to claim 16, wherein the supporting rack has a support hollow pillar protruding upwardly from the top thereof, the burner hollow pillar has internal threads connected to external pillar threads of the support hollow pillar.

18. The burner according to claim 17, further comprising an inject tube located between the support hollow pillar and the burner hollow pillar.

19. The burner according to claim 1, wherein the burner cap having:

a) a burner hollow pillar connected to the hood and having an air flow guide and a plurality of side holes located on a top thereof;

b) a flame outlet and a plurality of air flow distributors with round teeth located on a center of the air flow guide;

c) a block ring located on a top of the burner hollow pillar and covering the plurality of side holes; and d) an air inlet hole located through a side wall of the burner hollow pillar and providing air to the air flow guide, wherein the supporting rack has a support hollow pillar protruding upwardly from the top thereof, the burner hollow pillar has internal threads connected to external pillar threads of the support hollow pillar.

20. The burner according to claim 19, further comprising an inject tube located between the support hollow pillar and the burner hollow pillar.

* * * * *